US009393704B2

(12) United States Patent
Yoshida

(10) Patent No.: US 9,393,704 B2
(45) Date of Patent: Jul. 19, 2016

(54) SCISSORS

(71) Applicant: PLUS CORPORATION, Tokyo (JP)

(72) Inventor: Naoya Yoshida, Tokyo (JP)

(73) Assignee: PLUS CORPORATION, Tokyo (JP)

( * ) Notice: Subject to any disclaimer, the term of this patent is extended or adjusted under 35 U.S.C. 154(b) by 120 days.

(21) Appl. No.: 14/224,333

(22) Filed: Mar. 25, 2014

(65) Prior Publication Data

US 2014/0290071 A1 Oct. 2, 2014

(30) Foreign Application Priority Data

Apr. 1, 2013 (JP) ..... 2013-076440

(51) Int. Cl.
*B26B 13/06* (2006.01)

(52) U.S. Cl.
CPC ..... *B26B 13/06* (2013.01)

(58) Field of Classification Search
CPC ..... B26B 13/06
See application file for complete search history.

(56) References Cited

U.S. PATENT DOCUMENTS 693,575 A * 2/1902 Thuillier ..... B26B 13/06 30/254
4,422,240 A * 12/1983 Wallace ..... A01G 3/0475 30/254
4,709,480 A * 12/1987 Takigawa ..... B26B 13/06 30/254
7,017,462 B2 * 3/2006 Hullam ..... B26B 13/06 225/1
8,590,428 B2 * 11/2013 Ahlberg ..... A61B 17/320016 76/106.5
2001/0037712 A1 * 11/2001 Furuhata ..... B26B 13/06 83/694
2009/0293287 A1 * 12/2009 Suzuki ..... B26B 13/06 30/226
2013/0305543 A1 * 11/2013 Yonetsu ..... B26B 13/06 30/254
2014/0290071 A1 * 10/2014 Yoshida ..... B26B 13/06 30/254

FOREIGN PATENT DOCUMENTS

| | | | |
|---|---|---|---|
| DE | 2133228 | * | 1/1973 |
| DE | 35 03 767 | A1 * | 8/1986 |
| DE | 199 60 439 | A1 * | 6/2001 |
| DE | 10 2005 006 085 | A1 * | 8/2006 |
| FR | 1001351 | * | 2/1952 |
| GB | 13866 | * | 2/1912 |
| WO | WO 99/06189 | * | 2/1999 |
| WO | WO 2005/065895 | A1 * | 7/2005 |
| WO | WO 2013/178049 | A1 * | 12/2013 |

* cited by examiner

*Primary Examiner* — Hwei C Payer
(74) *Attorney, Agent, or Firm* — The Marbury Law Group, PLLC

(57) ABSTRACT

Scissors include two scissor members. The two scissor members are pivotably connected with a joint member. The each scissor member includes a blade portion linked to a connecting portion. The blade portion includes a curved blade and an intermediate portion width between a tip and a base portion is made widest. The curved blade includes a receding portion between an end portion of the base portion side and a side edge of the connecting portion and is formed such that a curvature is larger at a base portion side than a tip side. An arc-shaped surface groove is formed on a rear surface of the blade portion along the curved blade. The blade portion is formed such that the rear surface thereof is formed in a concave shape so as to form the arc-shaped surface groove.

2 Claims, 11 Drawing Sheets

(a)

(b)

SCISSORS

CROSS-REFERENCE TO RELATED APPLICATION

This application is based upon and claims the benefit of priority under 35 USC 119 of Japanese Patent Application No. 2013-076440 filed on Apr. 1, 2013, the entire disclosure of which, including the description, claims, drawings, and abstract, is incorporated herein by reference.

FIELD OF THE INVENTION

The present invention relates to scissors for cutting various types of paper, tape and cloth in offices or at general homes.

BACKGROUND OF THE INVENTION

Currently, it is desired that scissors for use in offices or at homes are given such sizes and weights that enable female persons and children to use them with one hand easily and can be opened and closed lightly with tips of fingers including a thumb to cut various types of paper and cloth easily. However, after repeated cutting of materials having adhesive such as adhesive tapes with the scissors, accumulated glue separated from the materials sticks to rear surfaces of blade portions, whereby cutting capability of the scissors is deteriorated or cutting operation is made sticky.

Therefore, a space is defined in a rear surface of each of blade portions by forming an arc-shaped concave recess (called as "Hizoko" or "Urasuki" in Japanese) on the rear surface of each of blade portions in order to prevent each whole face of the rear surfaces of blade portions facing each other from contacting together when the scissors being used. With such configuration, only blades of the blade portions contact to each other firmly, whereby shearing force thereof can be enhanced and also the operationality of the scissors can be enhanced by making a operation of the scissors lighter.

KOKAI (Japanese Unexamined Patent Publication) No. 2003-62362 discloses scissors whose rear surfaces of blade portions are formed so as to have arc-like concave sectional shape (called as "Urasuki" in Japanese) so that cutting capability of the scissors is enhanced and the enhanced cutting capability lasts long.

However, with the scissors disclosed in KOKAI (Japanese Unexamined Patent Publication) No. 2003-62362, when a cardboard or the like is cut, although a large magnitude of force can be applied to roots of two cutting blades, an opening angle formed between the two blades becomes large, and an object to be cut is allowed to move so as to escape from tips of the cutting blades, whereby resulting from time to time in a situation in which the object cannot be cut. Thus, users have had difficulty in cutting an object to be cut with a small force from time to time.

SUMMARY OF THE INVENTION

The invention has been made in view of the above mentioned problems of the conventional art, and an object thereof is to provide scissors which can cut an object to be cut easily by use of cutting blades from roots to tips thereof, and can prevent accumulated glue from sticking to the cutting blades.

In scissors according to the invention, two scissor members are pivotably connected each other at a connecting portion thereof with a joint member, the scissor members each include a blade portion linked to the connecting portion, the blade portion includes a curved blade which is the cutting blade formed in arc-like curved shape from the tip to the base portion and a width of the blade portion is made widest at an intermediate portion between the tip and the base portion, an end portion of the curved blade which lies at the base portion is caused to recede further away from a side edge of the connecting portion so as to form a receding portion between the end portion of the curved blade which lies at the base portion and the side edge of the connecting portion, and an arc-shaped surface groove is formed along the curved blade on a rear surface of the blade portion.

Preferably, in the scissors according to the invention, the rear surface of the blade portion is made in a concave shape and an arc-shaped surface groove is formed on the rear surface of the blade portion along the curved blade, and a front surface of the blade portion is made in a convex shape and includes a ridge line along the cutting blade with the arc-shaped surface groove being formed on the rear surface thereof.

Preferably, the curved blade is formed such that a curvature is larger at the base portion side than the tip side of the blade portion.

According to the present invention, there is provided scissors which can cut an object to be cut easily by using the cutting blades from roots to tips thereof, and can prevent accumulated glue from sticking to the cutting blades.

A shape of the blade portion, which includes the arc-shaped surface groove with a front side being convex shape and a rear surface being concave shape, can be formed using press working, whereby a manufacturing process can be accelerated and strength of the blade portion can be enhanced with the shape thereof.

In addition, by changing curvature of the curved blades from roots to tips, a change of an angle at which the curved blades intersect from the roots to the tips can be extremely reduced while the scissors being used, whereby the scissors can constantly cut an object to be cut.

BRIEF DESCRIPTION OF THE DRAWINGS

FIGS. 10A and 10B are schematic cross-sectional views of the scissors according to the embodiment of the invention showing a state in which the scissors are cutting tapes or the like.

DESCRIPTION OF PREFERRED EMBODIMENT

Figure 1:
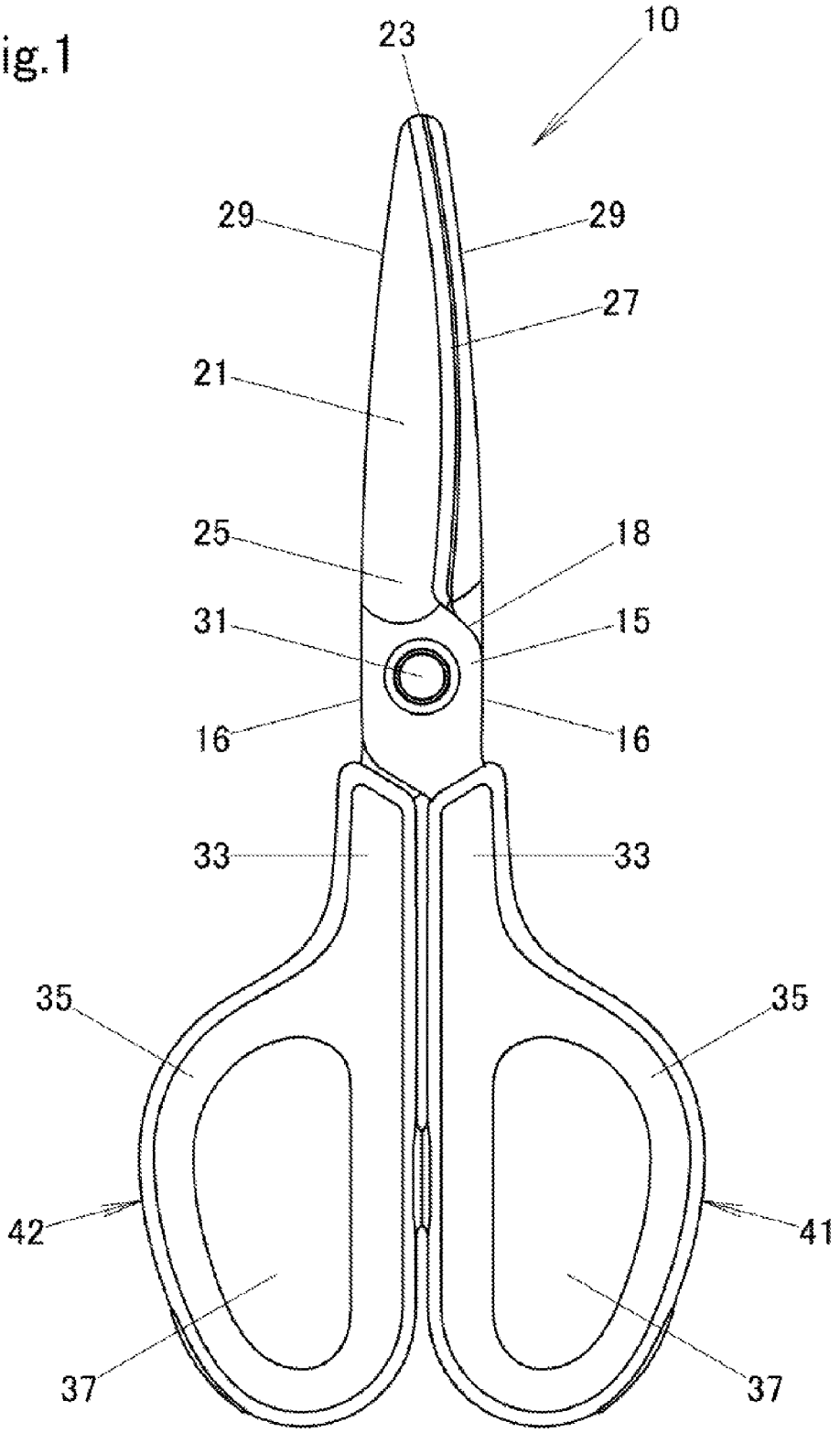
FIG. 1 is a front view of scissors according to an embodiment of the invention showing a state in which the scissors are closed.
Figure 2:
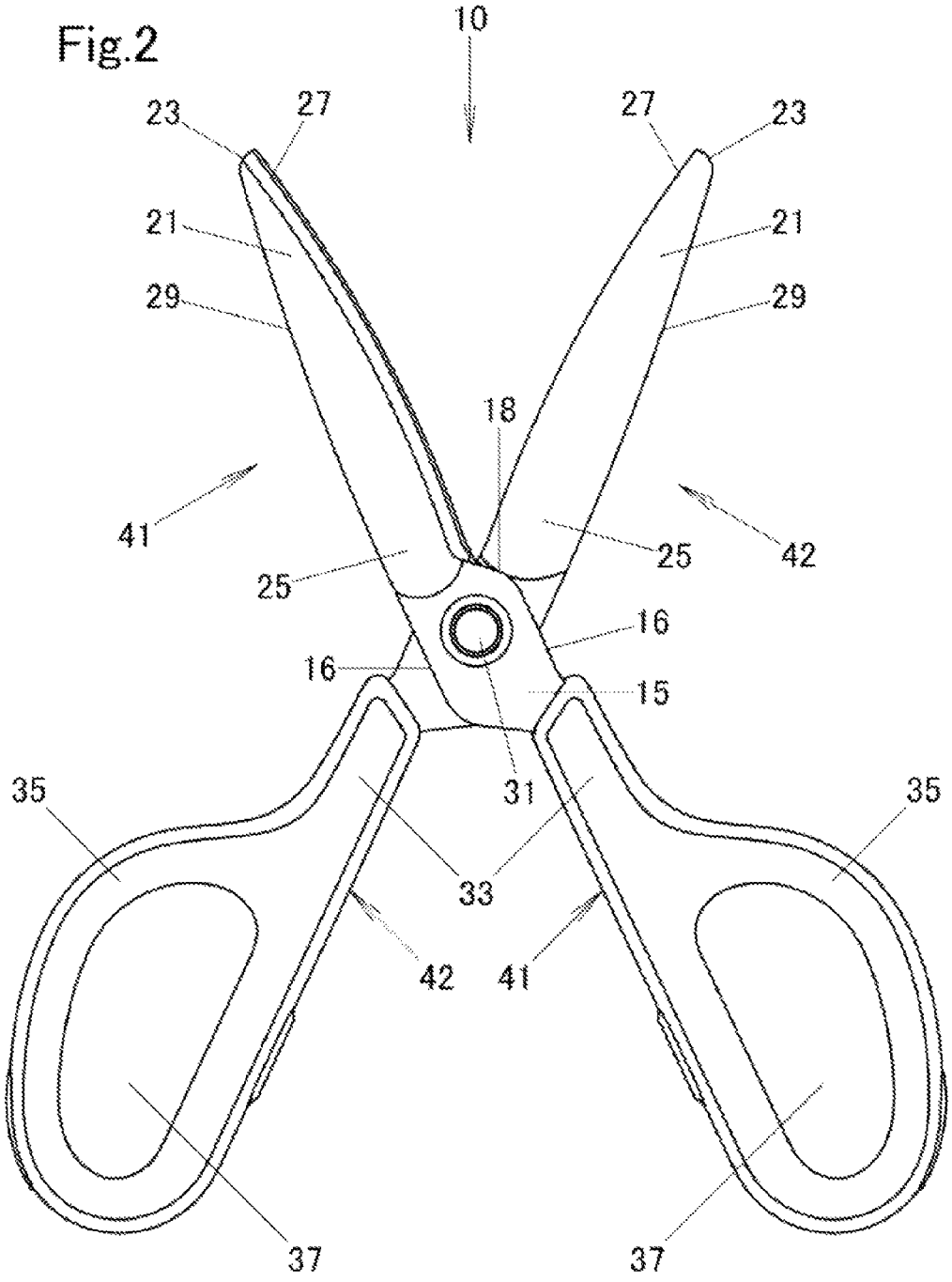
FIG. 2 is a front view of the scissors according to the embodiment of the invention showing a state in which the scissors are opened.

As shown in FIGS. 1 and 2, in scissors 10 according to the invention, a cutting blade 27, which is a curved blade, formed on blade portions 21 has a curvilinear shape. A receding portion 18 is formed at a base portion 25 of each of the blade portions 21, and in this receding portion 18, the cutting blade 27 is caused to recede further away from a side edge 16 of a connecting portion 15 which connects a handle portion 33 including a grip portion 35 and the blade portion 21. In the scissors 10 according to the invention, the following description is made with the scissors 10 shown in FIG. 1 being referred to as a front face, the scissors 10 shown in FIG. 6 being referred to as a back face, a tip 23 side of a blade being referred to as forward, and a base portion 25 side of the blade being referred to as backward.

In the scissors 10, the scissors 10 are constituted by a pair of scissor members which are referred to as a first scissor member 41 and a second scissor member 42 hereinafter and which are formed left-right symmetrically with each other. the grip portion 35 of each of scissor members 10 has a finger/thumb hole 37 and is integrated with the connecting portion 15 via the handle portion 33. The connecting portion 15 has a screw as a joint member 31, whereby the first scissor member 41 and the second scissor member 42 are connected together so as to pivot relative to each other. In the first scissor member 41 and the second scissor member 42, the elongated plate-shaped blade portion 21 is provided so as to extend from the connecting portion 15. One side of the blade portion 21 is formed into the cutting blade 27 and the other side is formed into a back portion 29.

A shape of the back portion 29 of the blade portion 21 is formed into a smooth curve that is close to a straight line and which has a large radius of curvature and extends continuously from the tip 23 of the blade portion 21 to the side edge 16 of the connecting portion 15. The handle portion 33 is formed with a straight-like or curved ridgeline extended from the side edge 16 of the connecting portion 15 in such a manner that the handle portion 33 is provided in the opposite direction to the blade portion 21 across the connecting portion 15.

The cutting blade 27 is curved so that the width of the blade portion 21 is increased at an intermediate portion between the tip 23 and the base portion 25 thereof, and the cutting blade 27 at the base portion 25 of the blade portion 21 is caused to recede further away from the side edge 16 of the connecting portion 15. The receding portion 18 is formed between a position lying near the end portion of the cutting blade 27 which lies at the base portion and the side edge 16 of the connecting portion 15. In addition, the handle portion 33 is provided with a straight or curved ridgeline extended from the side edge 16 in the opposite direction to the blade portion 21 across the connecting portion 15 so as to be connected to the side edge 16 of the connecting portion 15.

As described above, in the scissors 10, the cutting blade 27 is formed in a curved shape and the curved direction of the cutting blade 27 in a vicinity of the base portion 25 of the blade portion 21 is directed toward a rotational center (corresponding to a center of the joint member 31) for opening or closing the blade portions 21 so as to form the receding portion 18, whereby the base portion 25 of the blade portion 21 is caused to recede further away from the side edge 16 of the connecting portion 15. By this configuration, as shown in FIG. 3, when the blade portions 21 of the first scissor member 41 and of the second scissor member 42 are widely opened, an angle "a" at which both the cutting blades 27 intersect each other can be made smaller than an opening angle "a" formed between center lines L of both the blade portions 21.

Figure 4:
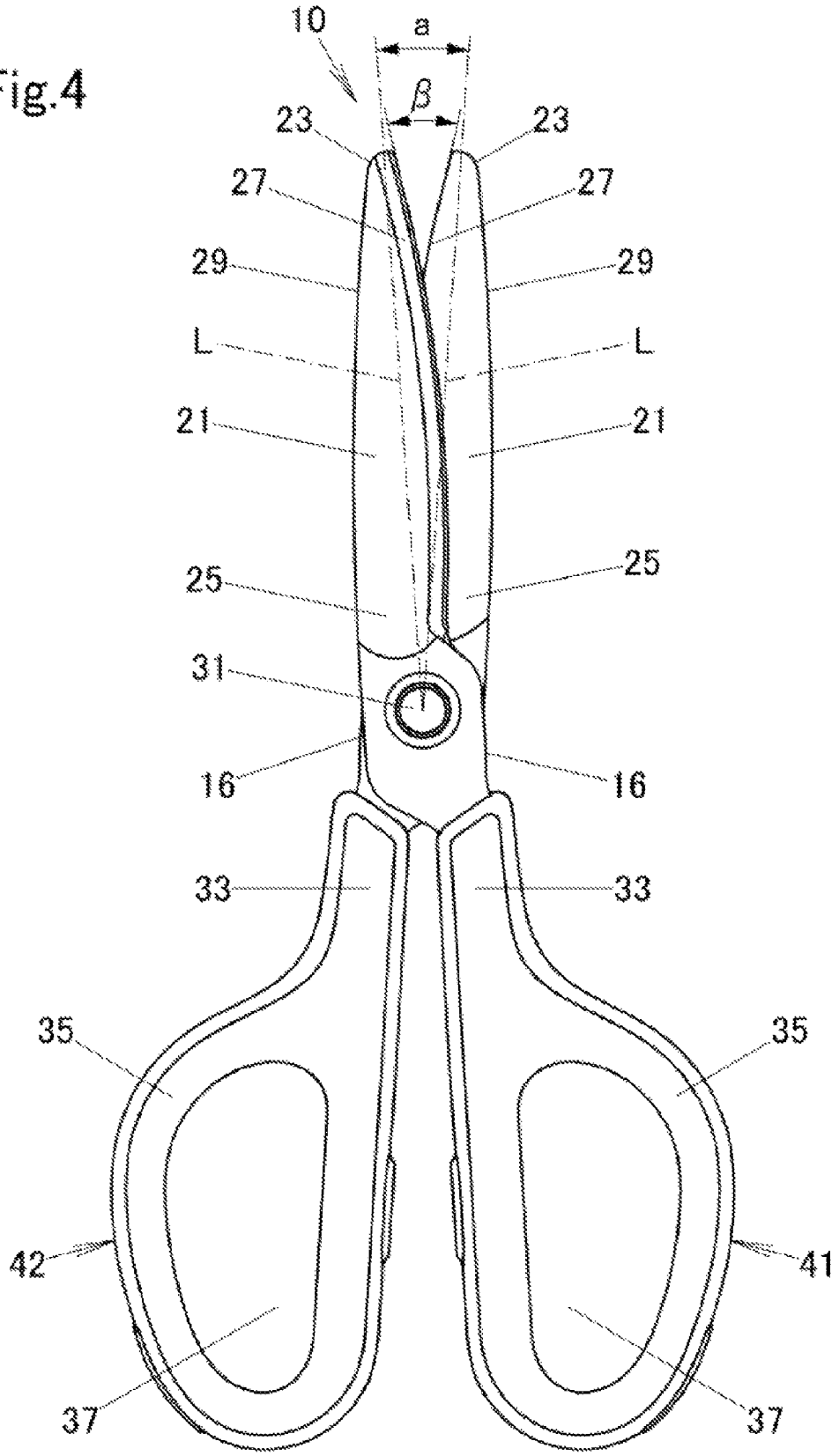
FIG. 4 is a front view of the scissors according to the embodiment of the invention showing a state in which the scissors are opened slightly.

In addition, as shown in FIG. 4, when the blade portions 21 of the first scissor member 41 and of the second scissor member 42 are slightly opened so as to be substantially superimposed each other, an angle "β" at which both the cutting blades 27 intersect each other can be made larger than the opening angle "a" formed between center lines L of both the blade portions 21. Because of this, in the scissors 10, a change of an angle at which the blade portions 21 intersect each other can be suppressed even though the opening angle a of the scissors 10 changes.

Figure 3:
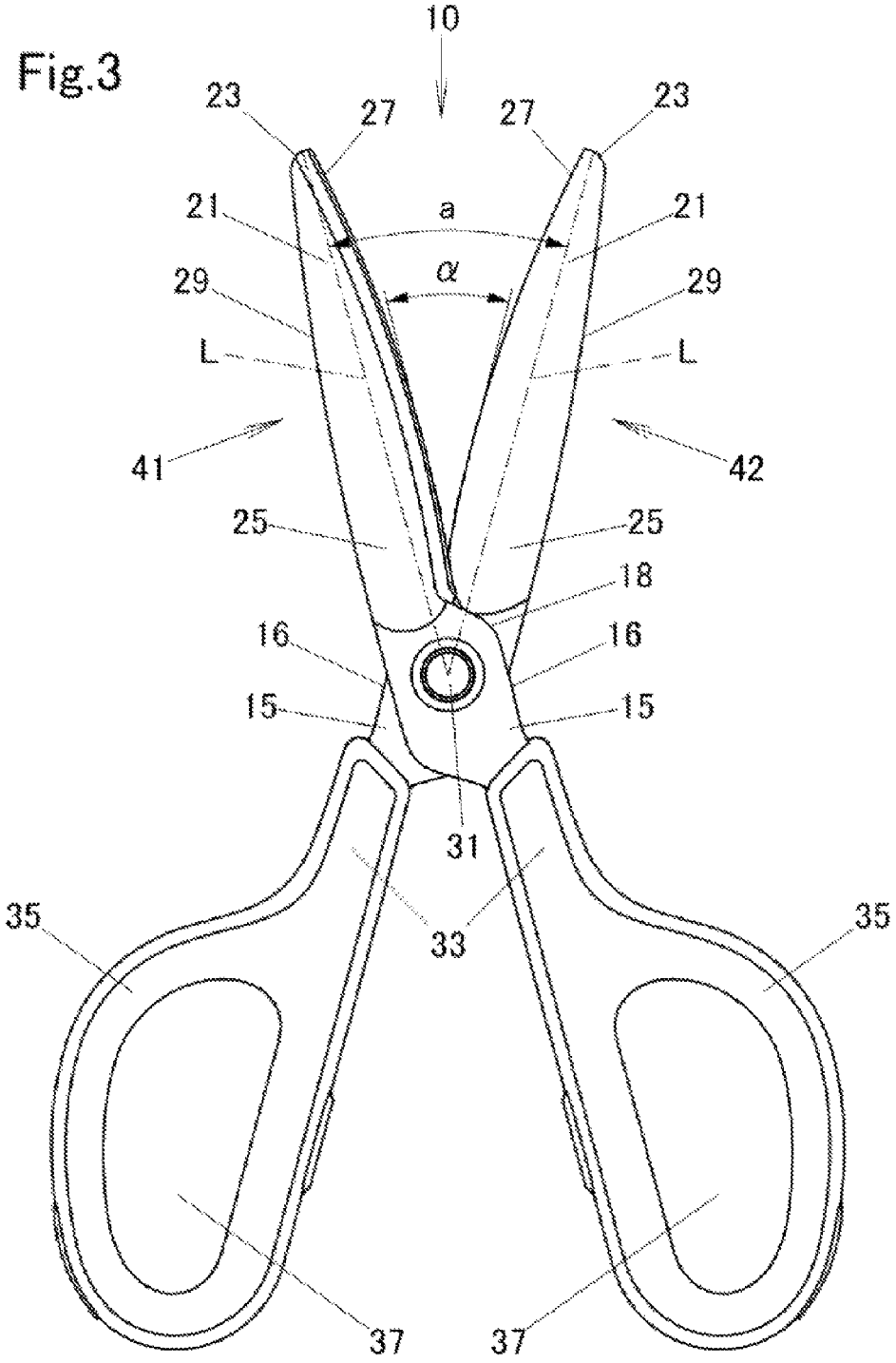
FIG. 3 is a front view of the scissors according to the embodiment of the invention showing a state in which the scissors are opened intermediately.

As shown in FIG. 3, the angle at which both the cutting blades 27 cross each other is set to be on the order of 30 degrees when the blade portions 21 of the scissors 10 are opened so that the cutting blades 27 are caused to intersect each other at deep portions thereof which are the base portions 25 of the blade portions 21.

In this way, by setting the angle at which both the cutting blades 27 cross each other to on the order of 30 degrees, an object to be cut can easily be cut when the object is attempted to be cut at deep portions of the blade portions 21.

Namely, when an object to be cut is cut with the scissors 10, as the angle at which the cutting blades 27 cross each other becomes smaller, a ratio of shearing becomes higher, and as the angle at which the cutting blades 27 cross each other becomes larger, a ratio of cutting becomes higher. When the angle at which the cutting blades 27 cross each other is on the order of 30 degrees, the ratio of shearing becomes equal to the ratio of cutting, and the cutting blades 27 are allowed to cut into an object to be cut such as cardboard without the object escaping. Thus, the object to be cut can be cut through cutting while shearing by closing the scissors 10 with a small force.

Figure 5:
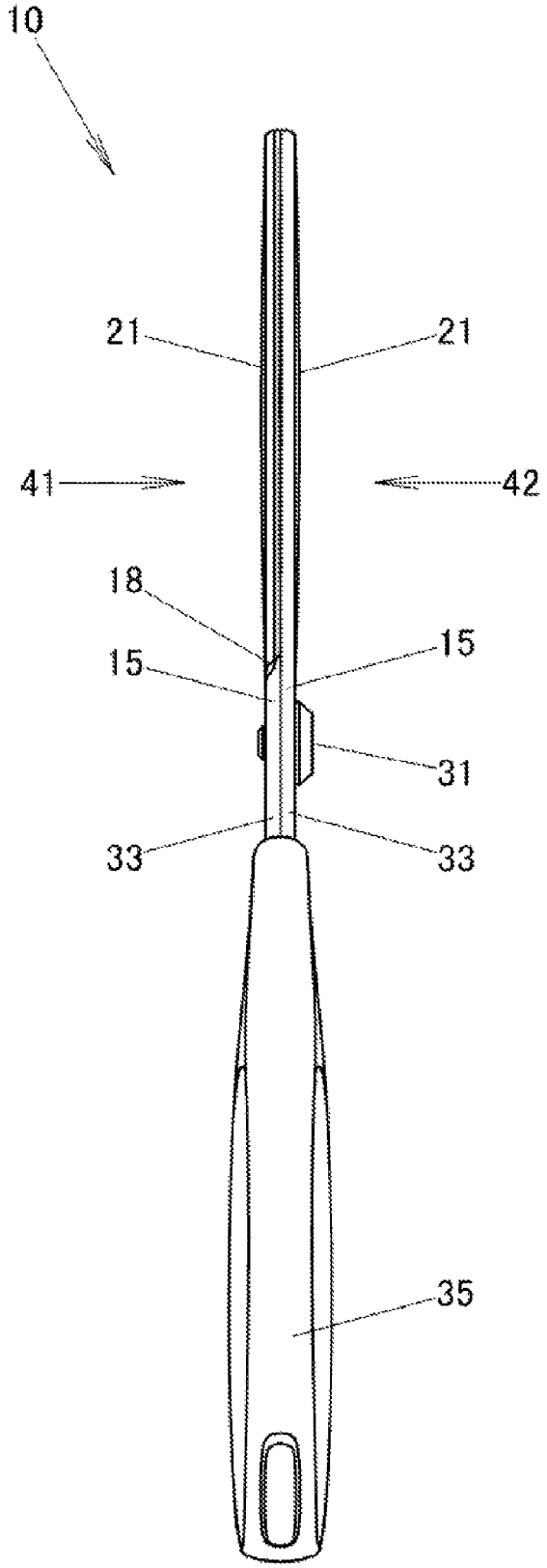
FIG. 5 is a side view of the scissors according to the embodiment of the invention showing a state in which the scissors are closed.

In the scissors 10, an arc-shaped surface groove is formed on a rear surface of the blade portion 21 so as to form a recess called "Hizoko" in Japanese, which is described later, and a ridge line 60 is formed on a front surface of the blade portion 21 along the cutting blade 27, whereby a concave surface and a convex surface are formed on the each blade portions 21. However, as shown in FIG. 5, degrees of the concave surface and the convex surface on the blade portions 21 are both so slight that the scissors 10 seem to have no difference from conventional scissors.

Figure 6:
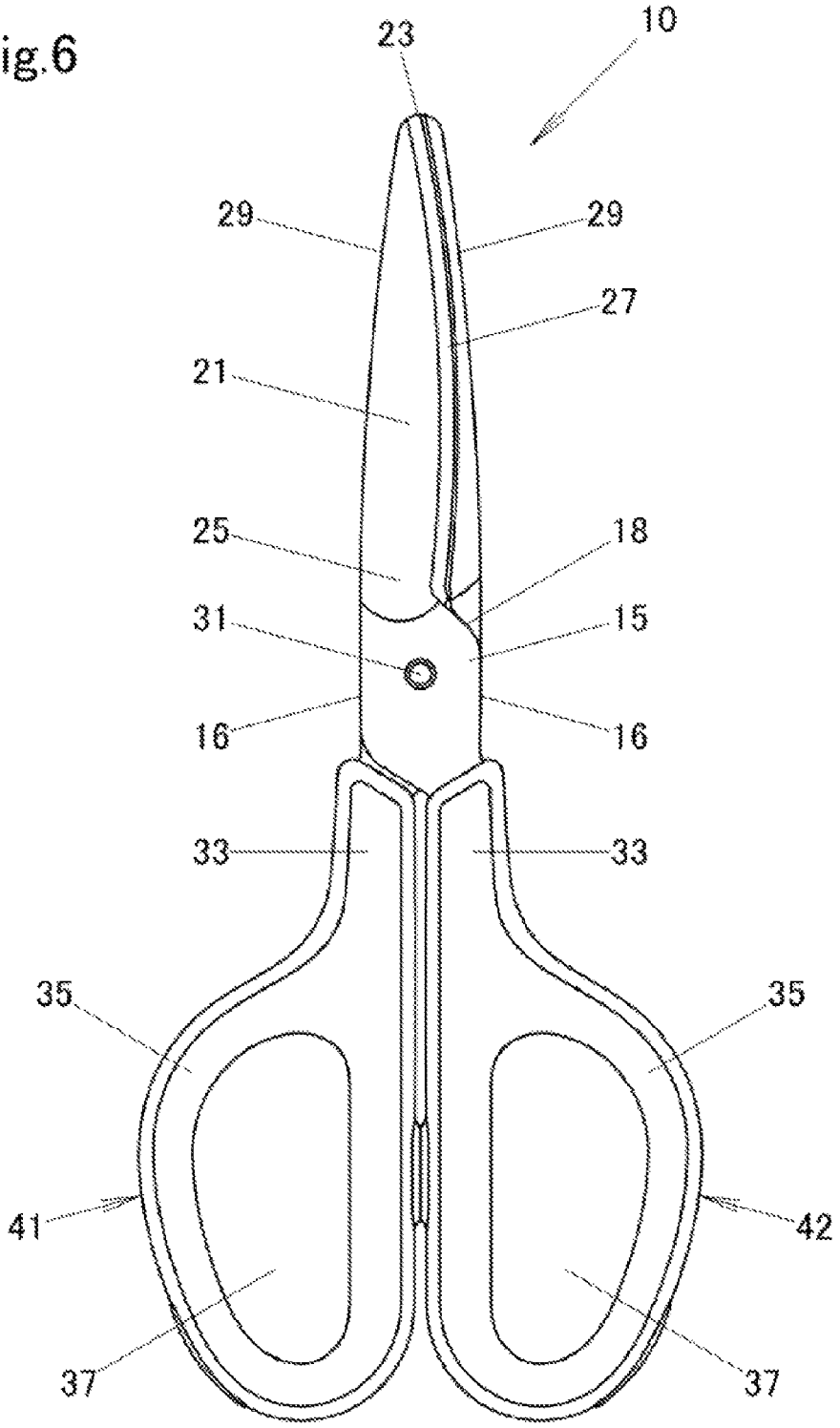
FIG. 6 is a rear view of the scissors according to the embodiment of the invention showing a state in which the scissors are closed.
Figure 7:
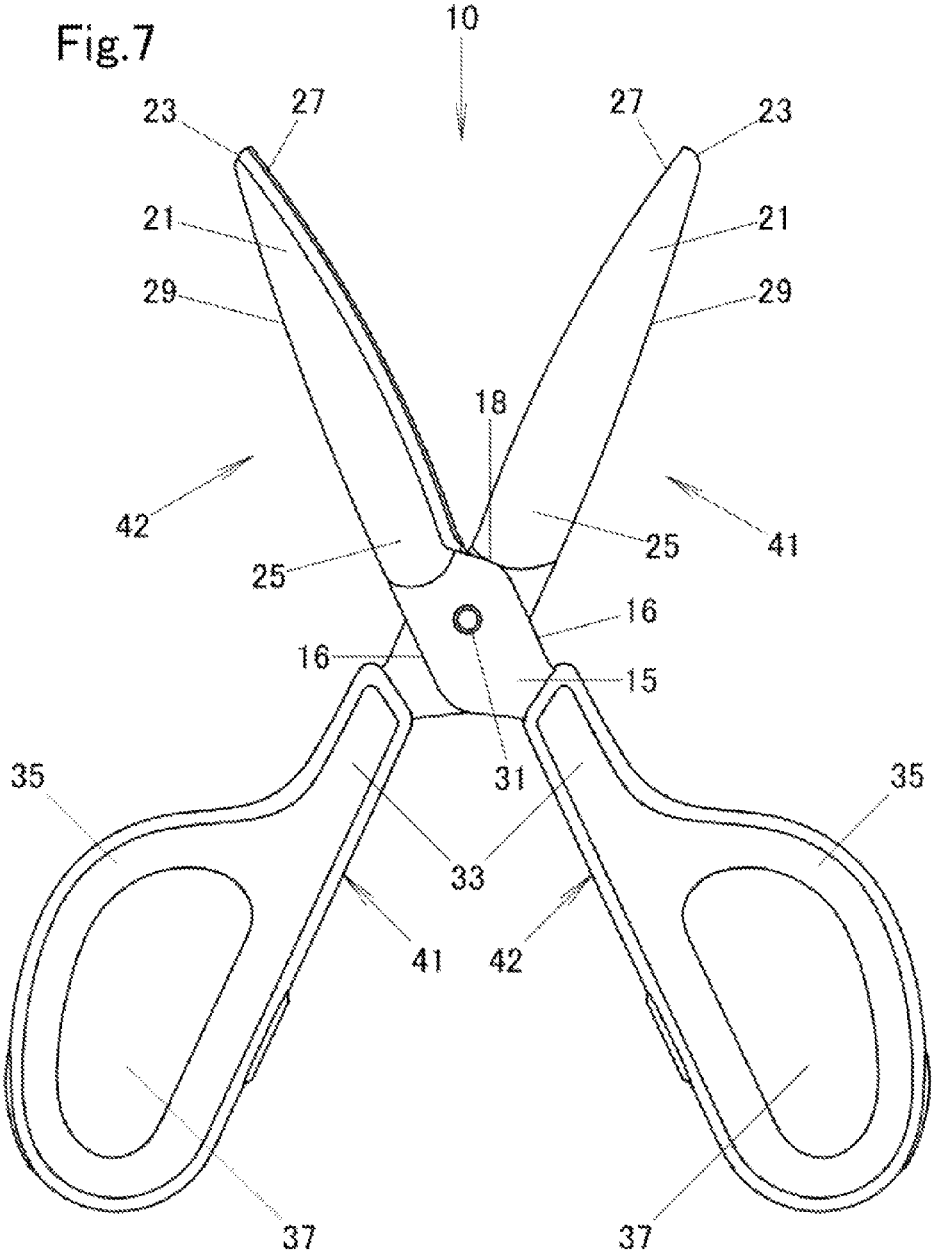
FIG. 7 is a rear view of the scissors according to the embodiment of the invention showing a state in which the scissors are opened.

In the blade portions 21 of the first scissor member 41 and the second scissor member 42, the receding portion 18 is formed between a base portion of the cutting blade 27 and the side edge 16 of the connecting portion 15 with a tangential direction of the cutting blade 27 being directed to a screw which is the joint member 31 at the base portion 25 of the blade portion 21. The back portion 29 of the blade portion 21 is formed extending continuously to the side edge 16 of the connecting portion 15. In addition, a shape of the blade portion 21 of the second scissor member 42 viewing from the back side as shown in FIGS. 6, 7 is identical to a shape of the blade portion 21 of the first scissor member 41 viewing from the front side as shown in FIGS. 1, 2 and both the blade portions 21 are disposed symmetrically.

In the scissors 10 according to the invention, the cutting blade 27 is curved so as to make the width of the blade portion 21 the widest at the intermediate portion thereof, and the curved blade is formed such that the curvature is made larger at the base portion side than the tip side of the blade portion 21. However, even with the larger curvature at the base portion side, the blade portions 21 of the first scissor member 41 and the second scissor member 42 are arranged not to protrude from the back portion 29 of the other scissor member mutually. In addition, an extension line of the curved shape of the cutting blade 27, or a line which is extended in the tangential direction from side edge of the cutting blade 27 positioned at the base portion 25 of the blade portion 21 are set so as to cross the joint member 31, whereby the angle at which the cutting blades 27 cross each other is set on the order of 30 degrees with slight variation, even though the opening angle of the blade portions 21 change.

In this way, in the scissors 10 according to the invention, an object to be cut can easily be cut without escaping when the object is attempted to be cut at deep portions of the blade portions 21. In addition, with the change of the angle at which the cutting blades 27 intersect each other being suppressed when the object is cut at the tips 23 of the blade portions 21, the object such as cardboard can be cut easily using whole cutting blades 27 through cutting without the ratio of cutting to shearing being reduced. Namely, the scissors 10 can cut the object to be cut easily by use of whole the cutting blades 27 from the base portions 25 to the tips 23 of the blade portions 21.

Figure 8:
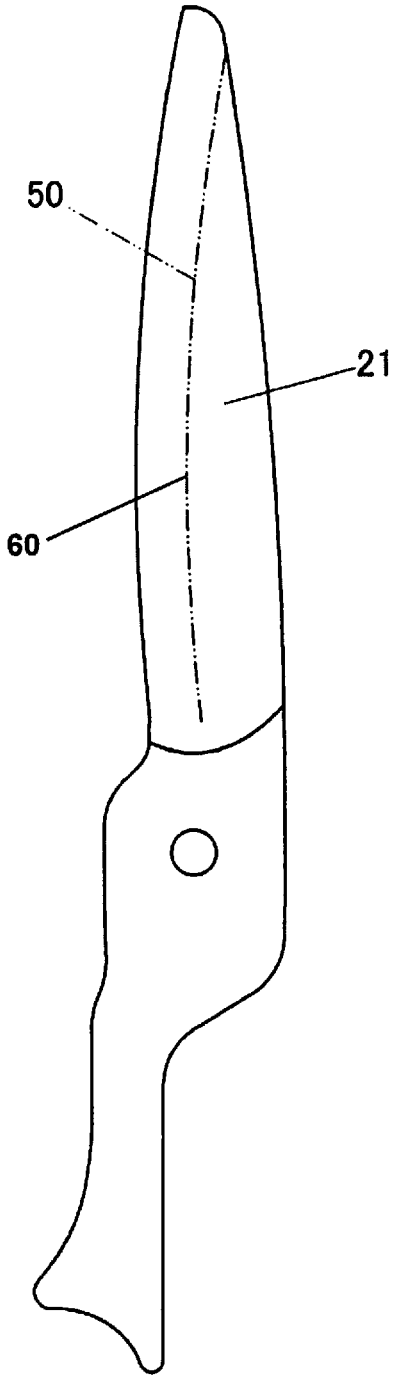
FIG. 8 is a rear view of a blade portion of the scissors according to the embodiment of the invention showing a recess (called as "Hizoko" in Japanese).
Figure 9A:
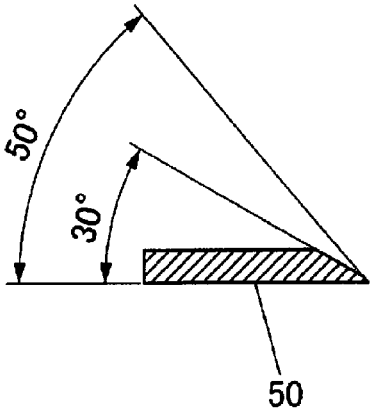
FIGS. 9A and 9B are sectional views of the scissors according to the embodiment of the invention showing a concave shape of the recess (called as "Hizoko" in Japanese).

Next, the recess which is called Hizoko 50 in Japanese and is an arc-shaped surface groove in the scissors 10 according to the embodiment of the invention will be described by referring to the accompanying drawings. FIG. 8 is a rear view of a blade portion 21 of the scissors 10 according to the embodiment of the invention showing a position of a Hizoko 50. FIG. 9 is a sectional view of a blade portion 21 of the scissors 10 according to the embodiment of the invention showing a concave shape of the Hizoko 50. FIG. 10 is a schematic cross-sectional view of the blade portions 21 of the scissors 10 facing one another according to the embodiment of the invention showing a state in which the scissors are cutting tapes or the like.

As shown in FIG. 8, the Hizoko 50 of the invention formed on the rear surface of both the blade portions 21 is made substantially parallel to a curve of a cutting edge line of each of the cutting blades 27, lies substantially at a center of a width of the blade portion 21, and is formed near a back side of the blade portion 21 and extends toward the tips 23 thereof. As shown in FIG. 9, the Hizoko 50 is formed by forming the arc-shaped surface groove having a concave shape on the rear surface of the blade portions 21, and by forming the front surface of the blade portions 21 which is formed into a convex shape having a ridge line 60 along the cutting blade 27.

Figure 9B:
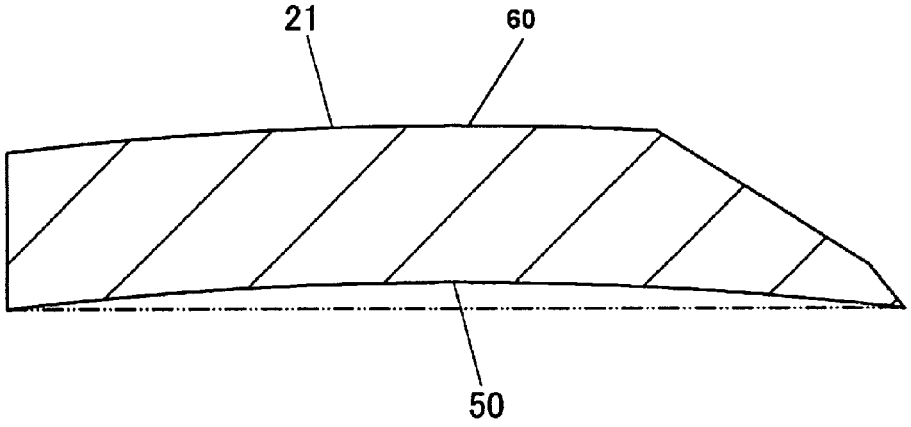
Figure 10A:
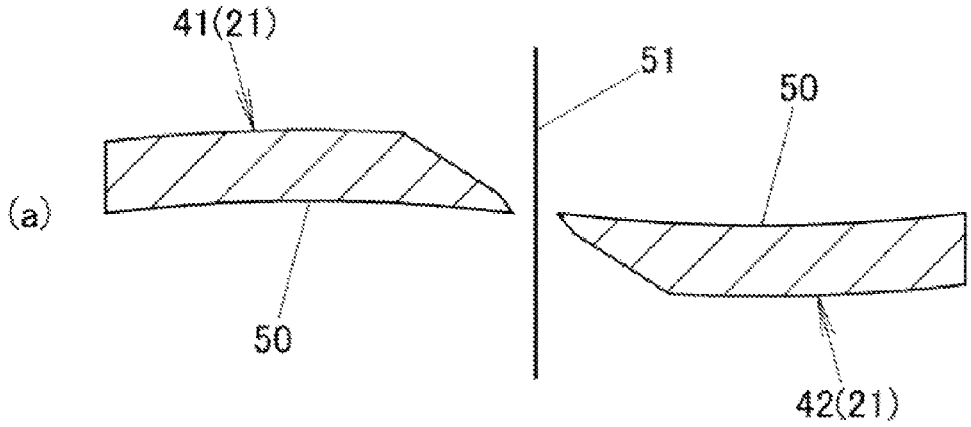
Figure 10B:
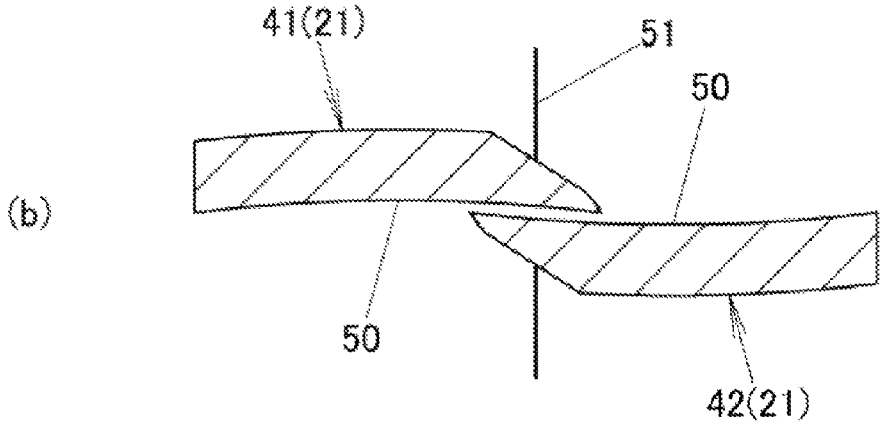

Specifically, as shown in FIG. 9B, the arc-shaped surface groove which is made to be the Hizoko 50 is a groove formed toward inward side of the rear surface from a curved line of the blade portion 21 which is the curved blade. The groove is formed into a gently arced shape in such a manner that, at the base portion 25, a bottom (the deepest depth) of the groove lies on substantially the center of the blade portion 21, and a depth of the groove is gradually reduced toward the back portion 29 which is a back side of the blade portion 21 and returns to a height of the cutting edge line of the cutting blade 27. In addition, at the tip 23, the groove of the arc-shaped surface groove does not reach to the depth which corresponds to the bottom (the deepest depth) as mentioned above but is formed into a very slight curve at the back portion 29 of the blade portion 21.

In the arc-shaped surface groove which is made to be the Hizoko 50, depth of the groove is too slight to be identified in FIG. 9A, but can be identified in an enlarged view of FIG. 9B. In the front surface of the blade portion 21, a convex portion is formed which is substantially parallel to an arc shape of the rear surface, and a ridge line 60 of the convex portion is formed corresponding to the lowest portion of the arc-shaped surface groove. As shown in FIG. 9A, acute angles of a blade of the blade portion 21 are: 50 degrees at a small blade which is cutting portion; and 30 degrees at an edge portion.

With such configuration, in the scissors 10, the blade portions 21 facing each other, each of which has the Hizoko 50, can define a space between the blades thereof when the scissors 10 being used. In transition from an adhesive tape 51 in a pre-cut state shown in FIG. 10A to the adhesive tape 51 in a post-cut state shown in FIG. 10B, the space prevents glue, which is separated from the adhesive tape 51 being cut, from entering in between the rear surfaces of the blade portions 21 via the edge line with being compressed.

A conventional method for forming the Hizoko 50 is a grinding process in which the Hizoko 50 is formed by grinding operation using a grinding stone. Because of this, unlike with a straight blade portions, the grinding operation on the blade portion which is the curved blade is difficult since the grinding operation is required to be performed with tracing the curve.

As a method for forming the Hizoko 50 on the cutting blade 27 which is the curved blade of the invention, press working for processing the blade portion is adopted, as shown in FIGS. 9A and 9B, in order to form the rear surface of the blade portions 21 into the concave shape and the front surface of the blade portions into the convex shape. With such a method, the Hizoko 50 having a deeper groove also can be formed easily and rapidly, and the glue from the adhesive tape 51 is prevented from accumulating and sticking to the rear surface of the blade portions 21 more efficiently with keeping rigidity and increasing strength of the blade portions 21.

In addition, in the scissors 10 of the invention, polishing and surface treatment processing can be reduced since the grinding process can be omitted, whereby a manufacturing cost can be reduced. Furthermore, the method can prevent failure such as deterioration in operability, which is caused by an increased load due to coming off of a coating layer when the blade is coated with fluororesin coating, which is a conventional surface treatment.

In this way, in the scissors 10 according to the invention, the cutting blades 27 are curved so that the width becomes widest at the intermediate portions of the blade portions 21, and the blade portions 21 are each shaped such that the end portion of the blade portion 21 which lies as the base portion is caused to recede further inwards than the side edge 16 of the connecting portion 15, whereby the object to be cut such as cardboard can easily be cut by using the blade portions 21 from the base portions 25 to the tips 23. Furthermore, the Hizoko 50 which is the arc-shaped surface groove can be formed through easy and rapid process in such a way as to be substantially parallel to the cutting blade 27 along the curved shape of the cutting blade 27 which is the curved blade. With such configuration, there can be provided the scissors 10 which prevent the accumulated glue separated from adhesive tapes when being cut from sticking to the rear surfaces of the blade portions 21, whereby the scissors 10 are easy to use for a long period.

Figure 11:
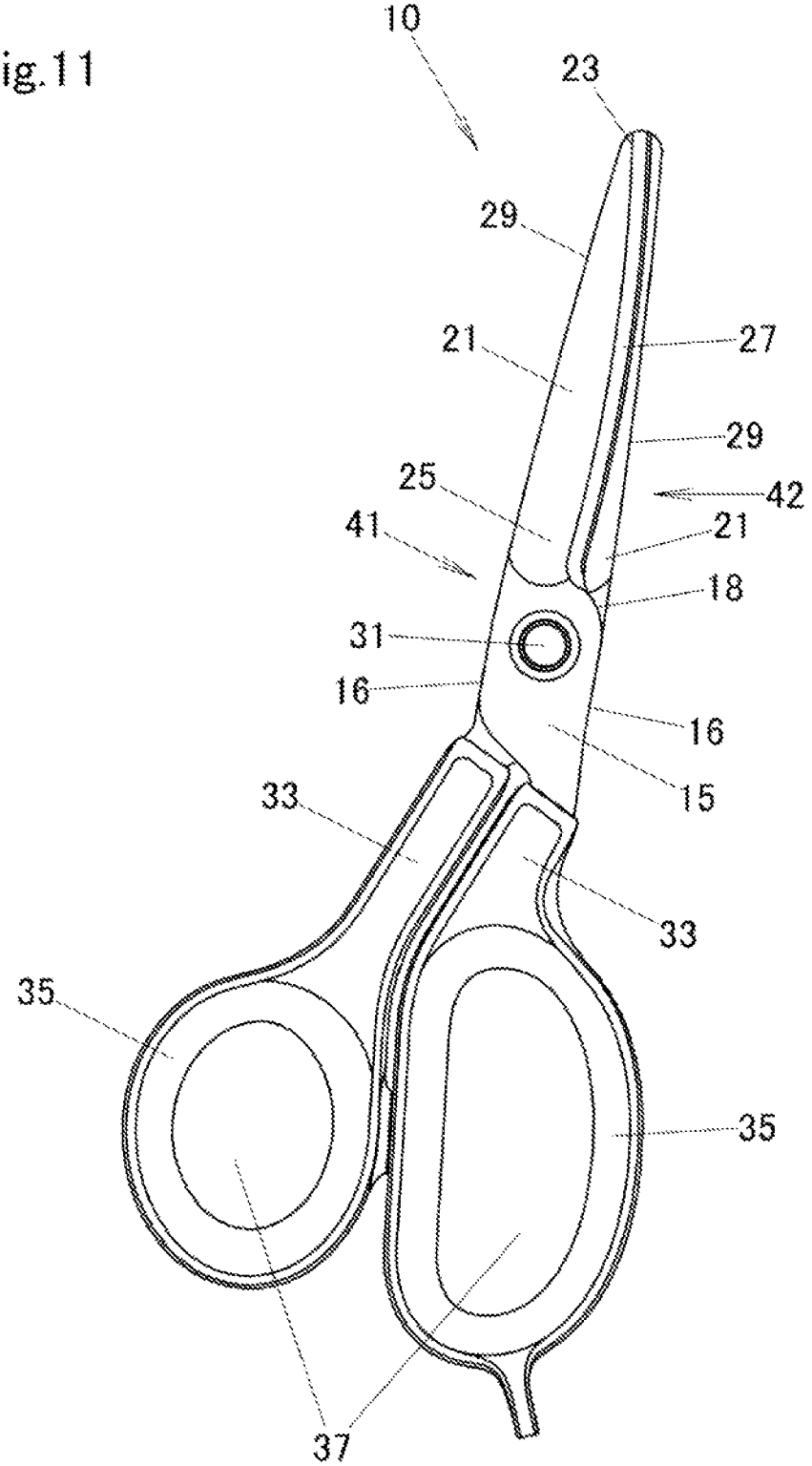
FIG. 11 is a front view of scissors according to an embodiment of the invention showing a state in which the scissors comprising left-right asymmetrical scissor members are closed.

Shapes of the handle portions 33 and the grip portions 35 of the scissor members are not limited to symmetrical shape, but the scissor members can be formed into asymmetrical shape having grip portions which are provided with predetermined asymmetric finger holes for a thumb and index finger, as shown in FIG. 11. Namely, if only the blade portion 21 has the back portion 29 smoothly and continuously extending from the connecting portion 15, the receding portion 18 which is continuously extended from the side edge 16 of the connecting portion 15 and the cutting blade 27 in curved shape whose extension line is directed to the joint member 31, it is regarded enough as required minimum essential elements of the blade portion 21 according to embodiments of the present invention.

In the embodiments described above, while the first scissor member 41 and the second scissor member 42 are pivotably connected to each other with the screw as the joint member 31, fixtures such as a small bolt and nut or a rivet can be used as required as the joint member 31, provided that the first scissor member 41 and the second scissor member 42 can be connected pivotably to each other.

As described heretofore, according to embodiments of the present invention, there is provided the scissors 10 which can cut an object to be cut easily by using the cutting blades 27 from the roots to tips thereof, and can prevent the accumulated glue from sticking to the cutting blades 27.

In addition, according to the embodiments of the present invention, a shape of the blade portions 21, which includes the front surface being convex shape and a rear surface being concave shape, can be formed using press working, whereby a manufacturing process can be accelerated and strength of the blade portions 21 can be enhanced with the shape thereof.

Furthermore, according to the embodiments, there can be provided the scissors 10 in which by changing curvature of the curved blades from roots to tips, the change of the angle at which the curved blades intersect from the roots to the tips can be extremely reduced while the scissors being used, whereby the scissors can constantly cut an object to be cut.

While the invention has been described based on the embodiment and its modified example, the embodiment and its modified example described only represent the examples of the invention, and hence, there is no intention at all to limit the scope of the invention by them. The novel embodiment can be carried out in other various forms and various omissions, replacements and alterations or modifications can be made thereto without departing from the spirit and scope of the invention. These embodiments and their modifications so made are to be included in the spirit and scope of the invention and are also to be included in the scope of inventions claimed under claims and their equivalents.

What is claimed is:

1. Scissors comprising:

two scissor members being pivotably connected to each other with a joint member at connecting portions, wherein each of the scissor members includes a blade portion which is linked to the connecting portion, each of the blade portions includes a curved blade which is a cutting blade formed in an arc-like curved shape from a tip to a base portion and a width of the blade portion is made to be widest at an intermediate portion between the tip and the base portion, an end portion of the curved blade which lies at the base portion is caused to recede further away from a side edge of the connecting portion so as to form a receding portion between the end portion of the curved blade which lies at the base portion and the side edge of the connecting portion, the receding portion is formed so as to direct a curved direction of the cutting blade toward a rotational center of the blade portion, an arc-shaped surface groove is formed along the curved blade on a rear surface of the blade portion, wherein the arc-shaped surface groove is configured to be substantially parallel to a curve of a cutting edge line of each of the cutting blades, lies substantially at a center of a width of the blade portion, is formed near a back side of the blade portion and extends toward the tip thereof, is deepest at the base portion and shallowest at the tip; and the blade portion includes an edge portion and a small blade whose acute angles are different from each other.

2. The scissors according to claim 1, wherein the rear surface of the blade portion is made in a concave shape so as to form the arc-shaped surface groove along the curved blade at the rear surface of the blade portion, and a front surface of the blade portion is made in a convex shape and includes a ridge line along the cutting blade with the arc-shaped surface groove being formed at the rear surface of the blade portion.

* * * * *